US005345838A

United States Patent [19]

Howie, Jr.

[11] Patent Number: 5,345,838

[45] Date of Patent: Sep. 13, 1994

[54] EASILY ASSEMBLED CALIBRATABLE DIAL

[75] Inventor: Robert K. Howie, Jr., Decatur, Ill.

[73] Assignee: The Grigoleit Company, Decatur, Ill.

[21] Appl. No.: 12,892

[22] Filed: Feb. 3, 1993

[51] Int. Cl.[5] ..... G05G 1/10

[52] U.S. Cl. ..... 74/553; 16/121; 116/309

[58] Field of Search ..... 74/553, 10 R, 10.1, 74/10.2; 16/121, 122; 116/309, 311, 316, 317, 308

[56] References Cited

U.S. PATENT DOCUMENTS

| | | | |
|---|---|---|---|
| 2,742,015 | 4/1956 | Hoyle | 116/311 |
| 3,421,474 | 1/1969 | Demi | 74/553 X |
| 3,450,091 | 6/1969 | Wajdik | 116/311 X |
| 3,584,197 | 6/1971 | Grayson | 116/309 |
| 3,670,284 | 6/1972 | Fortier et al. | 116/311 |
| 4,197,765 | 4/1980 | Shimoda | 74/553 |
| 4,213,416 | 7/1980 | Klingler | 116/309 |
| 4,417,483 | 11/1983 | Howie, Jr. | 74/553 |
| 4,446,811 | 5/1984 | Howie, Jr. | 116/309 |
| 4,464,794 | 8/1984 | Nakasho | 74/553 X |
| 4,633,356 | 12/1986 | Takahashi | 116/309 |
| 4,753,189 | 6/1988 | Mastman et al. | 116/308 |

FOREIGN PATENT DOCUMENTS

| | | | |
|---|---|---|---|
| 2518972 | 11/1975 | Fed. Rep. of Germany | 116/309 |

*Primary Examiner*—Vinh T. Luong

*Attorney, Agent, or Firm*—Dorn, McEachran, Jambor & Keating

[57] ABSTRACT

A knob and skirt assembly having a dial which can be calibrated relative to a control shaft and easily assembled in the proper position of alignment. The assembly includes a knob having a handle portion and hub portion. The knob portion has a control shaft receiving socket at the outer end thereof. The handle portion has an axially facing annular rim. At least one arcuate segment of teeth is formed on the annular rim. A disk shaped skirt has a central opening which fits over and receives the hub of the knob. A shallow well is formed in the skirt surrounding the central opening. Teeth formed in at least one arcuate segment are positioned in the well to mesh with the teeth on the annular rim. Ribs on the knob are heated and bent over against the skirt to fasten the knob to the skirt and to frictionally resist rotation of the hub and the skirt relative to each other until a predetermined rotational force is applied. An indexing notch is formed in the central opening of the skirt at the peripheral edge thereof. An indexing post is formed on the handle and extends through the indexing notch when the handle and skirt are assembled to align the skirt and the handle. The indexing post is removed from the notch when the ribs are bent over the skirt.

1 Claim, 1 Drawing Sheet

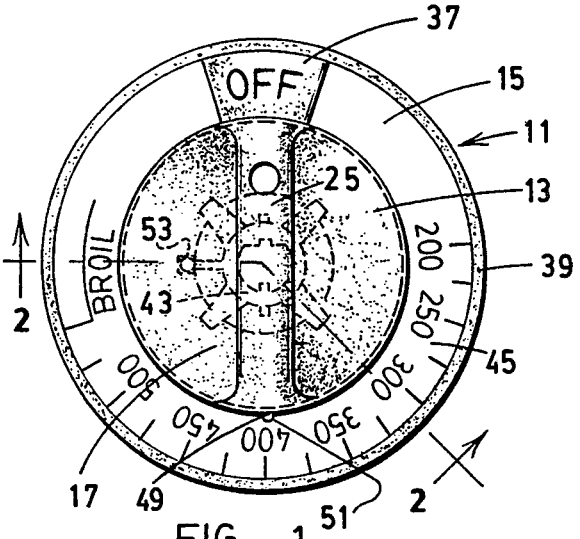
FIG. 1
FIG. 5
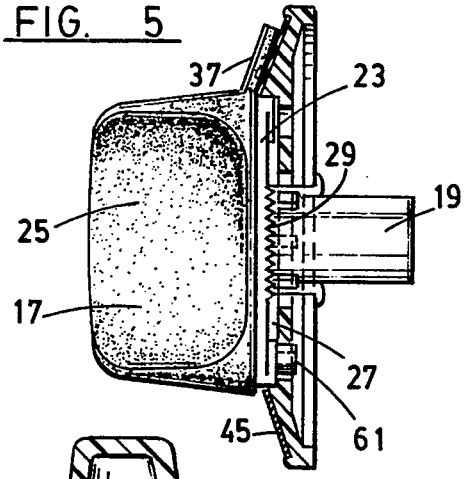
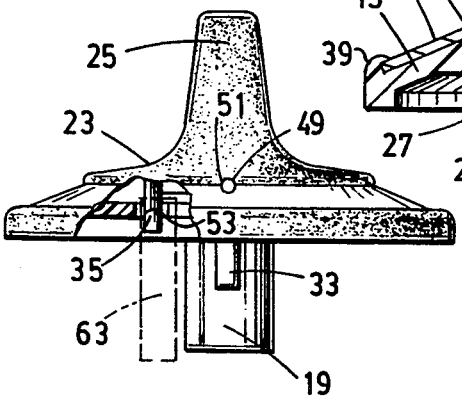
FIG. 3
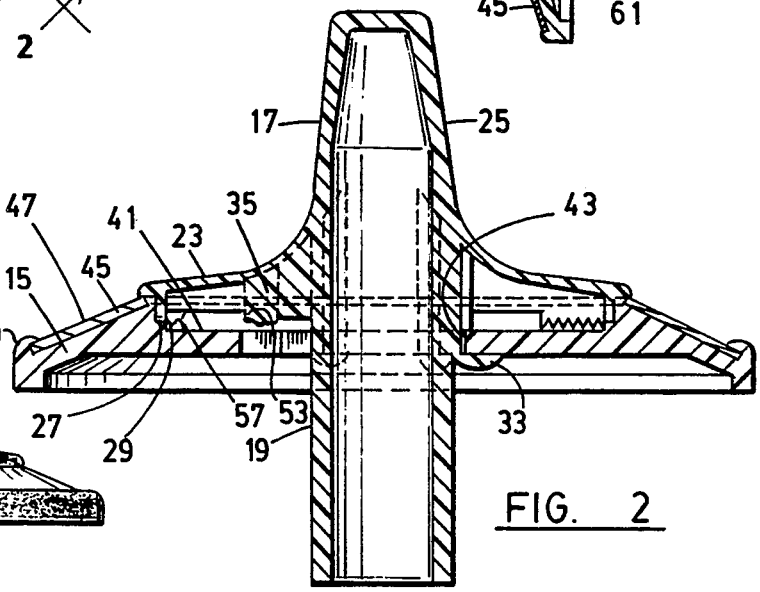
FIG. 2
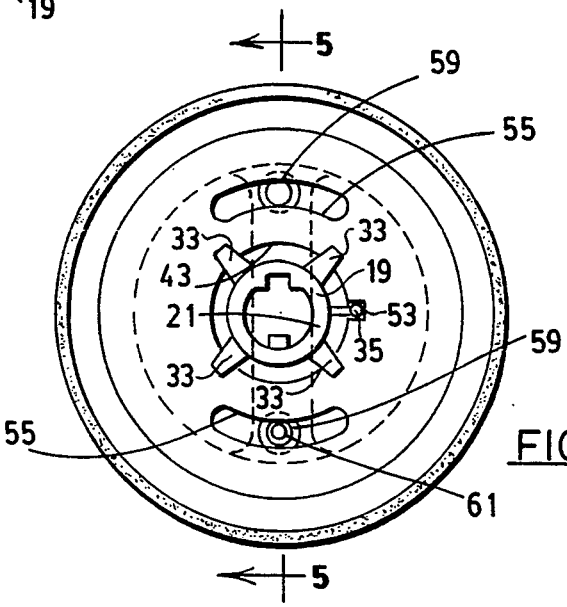
FIG. 4

EASILY ASSEMBLED CALIBRATABLE DIAL

SUMMARY OF THE INVENTION

This invention is concerned with a calibratable knob and skirt assembly that can be accurately and positively aligned during assembly.

An object of this invention is a positive alignment means between the knob and the dial of a skirt assembly which is automatically removed when the parts are fastened together during final assembly.

Another object of this invention is a calibratable knob and skirt assembly which can be finely calibrated while fully assembled.

Another object of this invention is a calibratable knob and skirt assembly having a positive stop which limits the maximum rotation of the dial and knob relative to each other during calibration.

Other objects may be found in the following specification, claims and drawings.

BRIEF DESCRIPTION OF THE DRAWINGS

The invention is illustrated more or less diagrammatically in the following drawings wherein:

FIG. 1 is a front view of the calibratable knob and skirt assembly of this invention with some hidden parts show in dashed lines;

FIG. 2 is an enlarged cross sectional view taken along line 2—2 of FIG. 1;

FIG. 3 is a side elevational side view of the knob and skirt assembly with parts broken away to show an intermediate step in the assembly process and an assembly tool shown in phantom lines;

FIG. 4 is a rear view of the assembled knob and skirt; and

FIG. 5 is a partial cross sectional view taken along line 5—5 of FIG. 4.

DESCRIPTION OF THE PREFERRED EMBODIMENT

FIG. 1 of the drawings shows a calibratable knob and skirt 11 which is intended to be mounted on the end of a shaft (not shown) of a fuel control device such as a valve or rheostat. The particular knob and skirt assembly shown in the drawings is intended for use on a shaft controlling a gas valve or an electrical rheostat on a stove or oven or similar appliance. However, the knob and skirt assembly of this invention should not be limited to only these particular devices but may be used on any control device having a rotatable shaft which must be calibrated relative to a dial.

The knob and skirt assembly 11 includes a knob 13 and a disk-like annular skirt 15. The knob has a handle portion 17 and a hub portion 19. The hub portion has a control shaft receiving socket 21 at its outer end. The handle portion includes a cylindrical base 23, a tapered blade portion 25 and an axially facing annular rim 27 surrounding the cylindrical base. Diametrically located tooth segments 29 are formed on the axially facing annular rim 27 of the handle portion.

The shaft receiving socket 21 is of irregular cross section designed to mate with a shaft (not shown) having a complementary configuration. The complementary shapes of the shaft receiving socket and the shaft provide for proper alignment of the hub of the knob with the shaft. The socket may have fingers (not shown) to frictionally engage the shaft to hold the knob firmly on the shaft. However, it should be understood that this invention is not limited to sockets having flexible fingers to hold the knob onto the shaft but can be adapted to a knob having any type of fastener means between the socket and the shaft. The knob may molded of any suitable plastic such as a heat resistant nylon.

Longitudinal ribs 33, in this example, four in number, are molded integrally on the periphery of the hub portion 19 and are located 90° apart. An indexing post 35 is molded integrally with the cylindrical base 23 of the handle portion and is located radially slightly outwardly of the hub portion 19 and circumferentially positioned between a pair of ribs 33. A thin radially outwardly extending tab 37 is molded integrally with the cylindrical base 23 of the handle portion 17 and carries a suitable indicia such as the word "OFF". The tab 37 overlies the skirt 15.

The annular skirt 15 is also formed of a suitable plastic and has a raised peripheral rim 39. A shallow well 41 is formed on what is the outer face of the annular skirt with a central opening 43 formed in the shallow well. A sloped annular outer surface 45 extends between the well and the peripheral rim 39 of the annular skirt. A narrow annular metal ring 47, preferably formed of aluminum, fits over the sloped annular surface 45 with its outer edge seated in the peripheral rim 39 of the annular skirt. Numerals and markings indicating temperatures and letters describing operating conditions are imprinted on the surface 45. A small stud 49 is formed on the sloped annular surface 45 of the skirt 15 to fit into a notch 51 in the annular metal ring 47 to orient the ring relative to the skirt and prevent its rotation.

A notch 53 is formed in the outer edge of the central opening 43 of the skirt 15 to receive the indexing post 35 during assembly of the skirt to the handle portion of the knob. A pair of diametrically opposed arcuate notches 55 are formed in the shallow well 41 of the skirt and a pair of diametrically opposed segments 57 of teeth are also formed on the well of the skirt, with the segments of teeth located generally at an angle of 90° relative to the arcuate notches 55. A pair of diametrically located hollow posts 59 are molded in the handle portion 17 Just inwardly of the annular rim 27 to align with the arcuate notches 55. At least one of the hollow posts is equipped with a stub post 61 which extends outwardly from the post 59 and rides in one of the arcuate notches 55 to limit rotation of the handle portion 17 relative to the skirt 15 during calibration adjustment of the handle relative to the skirt.

The invention facilitates the assembly of the handle portion 17 to the annular skirt 15. During assembly, the hub portion 19 of the handle 17 is inserted through the central opening 43 of the skirt 15 with the indexing post 35 of the handle aligned with and extending through the notch 53 at edge of the central opening of the skirt as shown in FIG. 3 of the drawings. The insertion of the indexing post 35 into the notch 53 will positively align the skirt 15 with the handle portion 17. The assembler cannot assemble these parts improperly. The ribs 33 will also extend through the central opening 43 for a short distance beyond the annular skirt 15.

A heating and bending tool 63 (a portion of which is shown schematically in FIG. 3) is then applied to bend the longitudinal ribs 33 radially outwardly over the annular skirt 15 as shown in FIGS. 2 and 4 to secure the handle portion 17 to the skirt for rotation. At the same time or in a subsequent operation, the tool 63 softens the indexing post 35 and remolds it so that it terminates a short distance inwardly of the annular skirt 15 (FIG. 2). Thus, the skirt is free to rotate relative to the handle portion. When the handle and skirt are aligned in this manner, the teeth of segments 29 formed on the annular rim of the handle portion mesh with the teeth of segments 57 formed on the skirt 15, thereby providing an incremental rotational calibration of the skirt relative to the handle. The stub 61 which rides in one of the arcuate notches 55 in the skirt prevents the teeth 29 of the handle portion from being moved out of meshing engagement with the teeth 57 of the skirt. Thus, the skirt can be calibrated relative to the handle through a limited arcuate movement defined by the movement of the stub 61 in an arcuate notch 55.

I claim:

1. A knob and skit assembly in which the knob and skirt are calibratable relative to each other including:

a knob having a handle and a hub extending from said handle, said hub having a control shaft receiving socket at the outer end thereof, a disk shaped skirt having a central opening adapted to fit over and receive said hub, means to secure said skirt to said handle for rotation relative thereto, an indexing notch formed in said central opening of said skirt at the peripheral edge of said opening, an indexing post formed on said handle and located to align said handle and said skirt when said post is aligned with said indexing notch in said skirt, means to limit rotation of said handle and said skirt relative to each other, an axially facing annular rim formed on said handle, a series of teeth formed in at least one segment on said annular rim, a shallow well surrounding said central opening formed on the side of said skirt facing said handle, and teeth formed in at least one arcuate segment in said well and positioned to mesh with said segment of teeth on said annular rim.

* * * * *